US007364478B2

(12) United States Patent
Xu

(10) Patent No.: US 7,364,478 B2
(45) Date of Patent: Apr. 29, 2008

(54) CONNECTOR AND METHOD FOR MANUFACTURING AND CONNECTING WIRE

(75) Inventor: Yi-Chen Xu, Chang Hwa (TW)

(73) Assignee: K.S. Terminals, Inc., Chang Hwa (TW)

( * ) Notice: Subject to any disclaimer, the term of this patent is extended or adjusted under 35 U.S.C. 154(b) by 0 days.

(21) Appl. No.: 11/515,796

(22) Filed: Sep. 6, 2006

(65) Prior Publication Data

US 2007/0224891 A1 Sep. 27, 2007

(30) Foreign Application Priority Data

Mar. 24, 2006 (TW) ..... 95110351 A

(51) Int. Cl.
*H01R 4/02* (2006.01)

(52) U.S. Cl. ..... 439/874; 439/948; 439/932; 439/730

(58) Field of Classification Search ..... 439/874, 439/736, 932, 523, 730, 860, 948
See application file for complete search history.

(56) References Cited

U.S. PATENT DOCUMENTS 783,333 A * 2/1905 Tower ..... 439/874
1,213,632 A * 1/1917 Hammond ..... 439/860
2,550,636 A * 4/1951 Bergan ..... 439/850
2,794,964 A * 6/1957 Hoffman ..... 439/877
RE24,510 E * 8/1958 Macy ..... 439/877
3,010,745 A 11/1961 Blomstrand et al.
3,243,211 A 3/1966 Wetmore
3,525,799 A 8/1970 Ellis
3,676,574 A 7/1972 Johansson et al.
3,708,611 A 1/1973 Dinger
3,728,669 A * 4/1973 Churla ..... 439/859
3,814,139 A 6/1974 Loyd et al.
3,985,951 A 10/1976 Harris
4,144,404 A * 3/1979 De Groef et al. ..... 174/88 C
4,209,211 A * 6/1980 Alford ..... 312/215
RE30,447 E 12/1980 Loyd et al.
4,341,921 A 7/1982 Simpson
4,346,145 A 8/1982 Choi et al.
4,454,376 A 6/1984 Holder et al.
4,556,276 A * 12/1985 Curtis, III ..... 439/862
4,576,871 A 3/1986 Oestreich (Continued)

*Primary Examiner*—Tho D. Ta
*Assistant Examiner*—Travis Chambers
(74) *Attorney, Agent, or Firm*—Reed Smith LLP; Stanley P. Fisher, Esq.; Juan Carlos A. Marquez, Esq.

(57) ABSTRACT

A terminal connector and wire connecting method thereof are disclosed. The terminal connector includes a metal electric wire terminal, a metal material with the low melting point and an insulated sleeve. One section of the metal electric wire terminal bends to a C-shaped section with a vertical slot where an electric wire is. Another section of the metal electric wire terminal used to connect an outer terminal. The metal material with the low melting point is embedded the vertical slot of the C-shaped section. The insulated sleeve mounted the C-shaped section and the metal material with the low melting point. Providing an application of heat melts the metal material with the low melting point, the C-shaped section, and the electric wire. At the same time, the insulated sleeve shrinks and wrapped the metal electric wire terminal connector and the electric wire. The connection of the connector assembly and the electric wire is complete.

19 Claims, 8 Drawing Sheets

U.S. PATENT DOCUMENTS 4,848,580 A 7/1989 Wise
4,863,535 A 9/1989 More
4,881,995 A 11/1989 Arenz
4,883,925 A 11/1989 Graf
4,894,030 A 1/1990 Chavaroux
4,910,090 A 3/1990 Kuhlman et al.
4,940,179 A 7/1990 Soni
4,983,133 A * 1/1991 Van Scyoc et al. ..... 439/860
4,993,149 A 2/1991 Zilligen et al.
5,137,478 A 8/1992 Graf et al.
5,221,815 A 6/1993 Bostock et al.
5,278,354 A 1/1994 Lhomme
5,308,924 A 5/1994 Lamome
5,331,113 A 7/1994 Soni et al.
5,369,225 A 11/1994 Natwig et al.
5,378,855 A 1/1995 Delalle
5,393,932 A 2/1995 Young et al.
5,397,858 A 3/1995 Delalle
5,418,331 A 5/1995 Delalle
5,514,836 A 5/1996 Delalle et al.
5,527,612 A 6/1996 Ohta et al.
5,762,526 A * 6/1998 Kuramoto et al. ..... 439/877
6,666,732 B1 * 12/2003 Endacott ..... 439/874

* cited by examiner

CONNECTOR AND METHOD FOR MANUFACTURING AND CONNECTING WIRE

BACKGROUND OF THE INVENTION

1. Field of the Invention

The present invention generally relates to a connector, in particular to a connector with a metal conductive end, which protects a conductive core of a wire after the combination of the connector and the wire.

2. The Prior Arts

The prior arts of a metal conductive end connector are mainly disclosed in U.S. Pat. No. 5,137,478, for the reference, see FIG. 1. Referring to FIG. 1, an end 12 of a connector 10 has a semi-circle shaped end 13 stuck to a thin semi-circle low melting point metal material 15 with a conductive adhesive layer 14. A conductive core 17 of a wire 19, exposed from an insulating skin 16 of the conductive core 17 in a certain length at an end thereof, is placed on the thin semi-circle low melting point metal material 15 and then applied an external heat source on an end 12 of the connector to fuse the thin semi-circle low melting point metal material 15 with both the end 12 of the connector and the conductive core 17 together solidly so as to complete the connection.

In prior arts, the end 12 is a semi-circle shape 13 and it often can not secure to place the conductive core 17 on the semi-circle shape 13 properly, in consequence, the metal conductive end 11 can not be jointed to the wire 19 together firmly; referring to the thin semi-circle low melting point metal material 15, as mentioned above, due to poor performance of the conductive adhesive layer 14, can easily be detached from each other and cause improper connection of the connector.

SUMMARY OF THE INVENTION

Based on the drawback of prior arts of a metal end connector whose mechanism causes inconvenience for users, the present invention provides an improved connector.

The present invention comprises a metal conductive end, a low melting point metal material, and an insulating sleeve. An end of the metal conductive end is folded into a C-shaped cylinder with a thin opening slot along its lengthwise forming a containing room inside so that it can insert and hold a wire in it, while another end of the wire is used for connecting an external conductive contact. The low melting point metal material is embedded in the thin opening slot of the C-shaped cylinder sleeved by an Insulating bush around it. When heating up both the low melting point metal material of the C-shaped cylinder and the insulating sleeve, low melting point metal material is melted into the thin opening slot of the C-shaped cylinder to joint the C-shaped cylinder and the conductive core of the wire inside the C-shaped cylinder, and also the insulating sleeve is contracted to sleeve both the metal conductive end and the wire so as to complete the connection of the connector and the wire.

Therefore, the first objective of the present invention is to provide a metal conductive end connector which makes assembly of the connector and the wire easier and more efficient.

The second objective of the present invention is to provide a metal conductive end connector, one end of the metal conductive end forms a sealed connection to the wire so as to have better insulating function.

The third objective of the present invention is to provide a metal conductive end connector, one end of the metal conductive end connects the wire to form a firm contact so as to achieve a better connection on a conductive mechanism.

The fourth objective of the present invention is to provide a metal conductive end connector, one end of the metal conductive end connects the wire to form a firm contact so as to enhance an intensity of the conductive mechanism.

The fifth objective of the present invention is to provide a manufacturing method of the metal conductive end connector that have a better assembly adaptability between components of the connector.

The sixth objective of the present invention is to provide a connection method of connecting the metal conductive end connector and the wire, and the connector has a better accommodation functionality for the conductive core of the wire when the connector jointing with the wire.

DETAILED DESCRIPTION OF THE PREFERRED EMBODIMENT

Due to the present invention discloses a metal conductive end connector and its assembly method, in which apply the wire configuration of the basic modules and combination theories, some of the detailed descriptions have been given in the prior acts above, the full description would not be given below so that avoid the repetition. Meanwhile, it is necessary to explain in advance that the drawings given below for contrasting figures are only to illustrate the different kind of mechanism related to the features of this invention instead of indicating the real dimensions of the connector.

Figure 1:
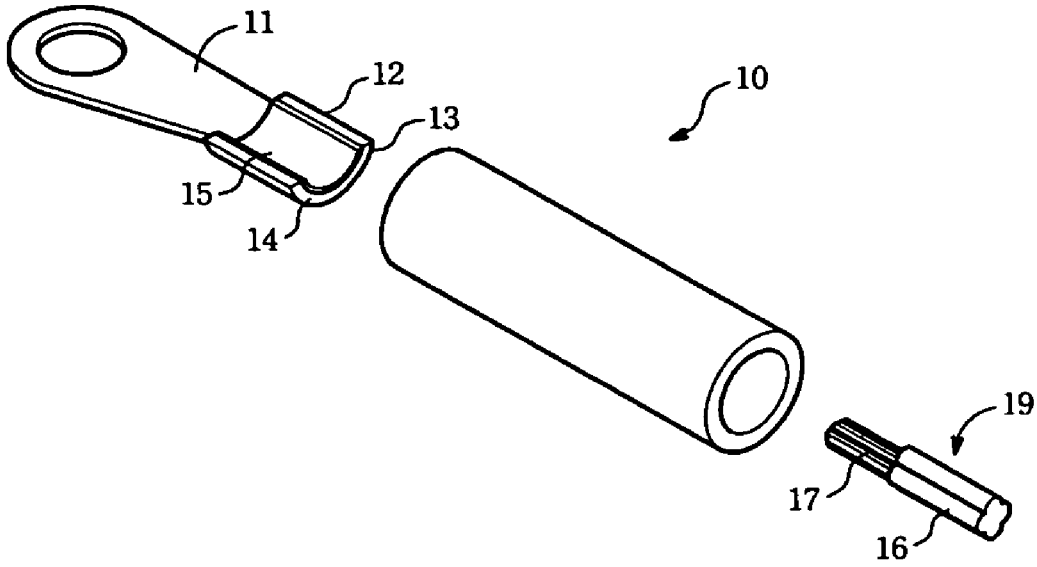
Fig 1(prior art)
FIG. 1 is a schematic three-dimensional view of a mental conductive end connector in prior arts.
Figure 2:
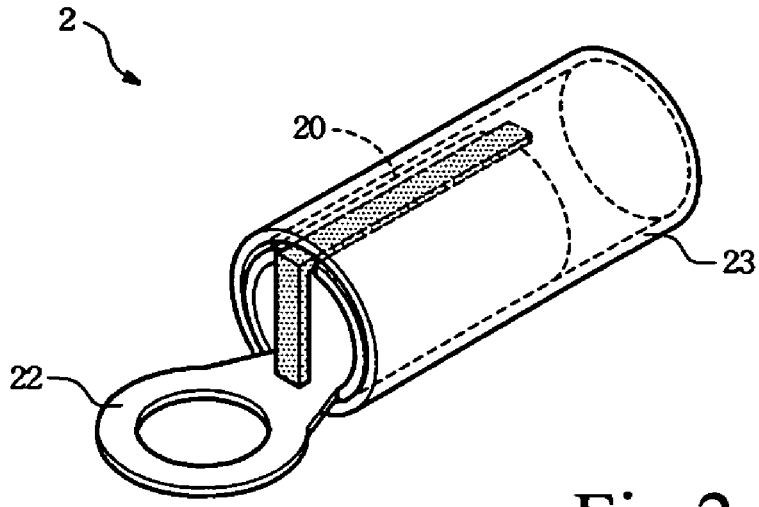
FIG. 2 is a schematic three-dimensional view of a preferred embodiment of the metal conductive end connector of the present invention.
Figure 3:
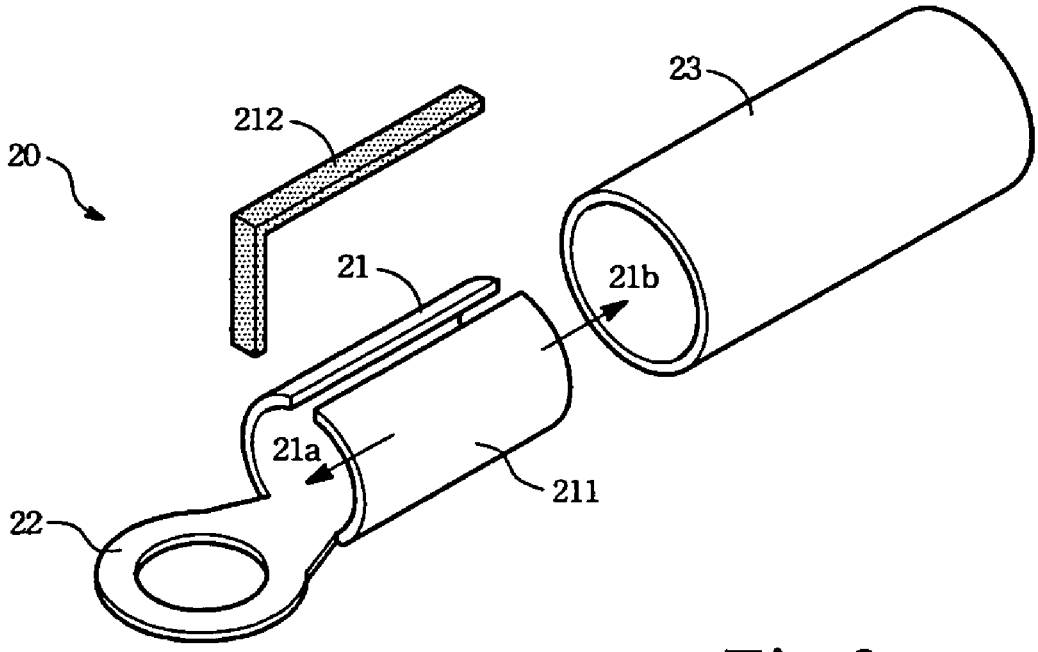
FIG. 3 is a schematic three-dimensional exploded view of the preferred embodiment of the metal conductive end connector of the present invention.

With reference to the drawings in particular to FIG. 2 and FIG. 3, illustrated one of the preferred embodiments of the present invention. In this preferred embodiment, the metal conductive end connector 2 comprises a metal conductive end 20, a low melting point metal material 212, and an insulating sleeve 23.

The metal conductive end 20 mainly comprises a first end 21 and a second end 22 which is opposite to the first end 21. The first end 21 is used to connect a wire, while the second end 22 is used for connecting with an exterior conductive contact.

Figure 5A:
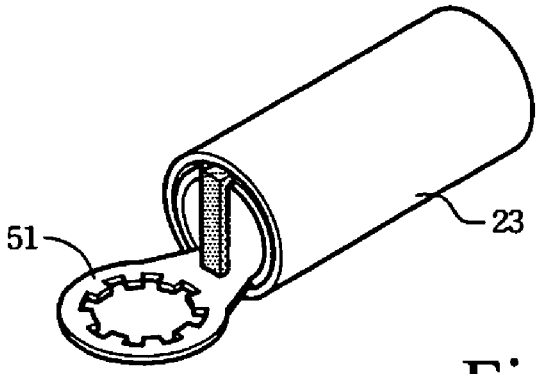
FIG. 5*a* is a schematic three-dimensional view of a preferred embodiment of the metal conductive end connector of the present invention.
Figure 5B:
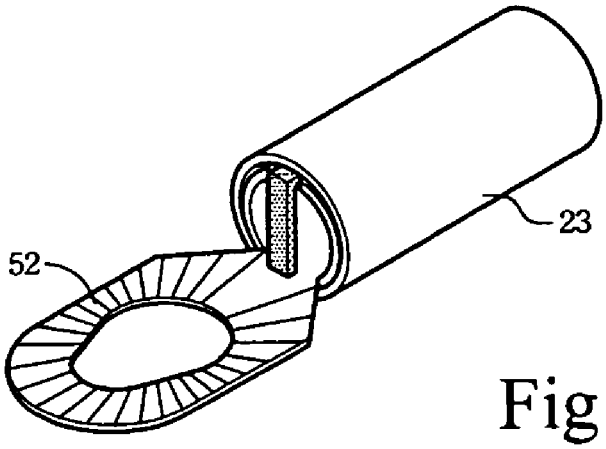
FIG. 5*b* is a schematic three-dimensional view of another preferred embodiment of the metal conductive end connector of the present invention.
Figure 5C:
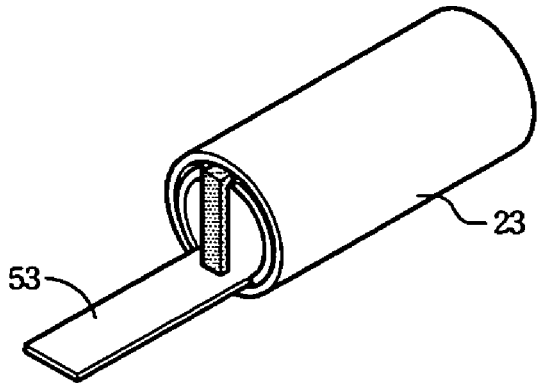
FIG. 5*c* is a schematic three-dimensional view of another preferred embodiment of the metal conductive end connector of the present invention.
Figure 5D:
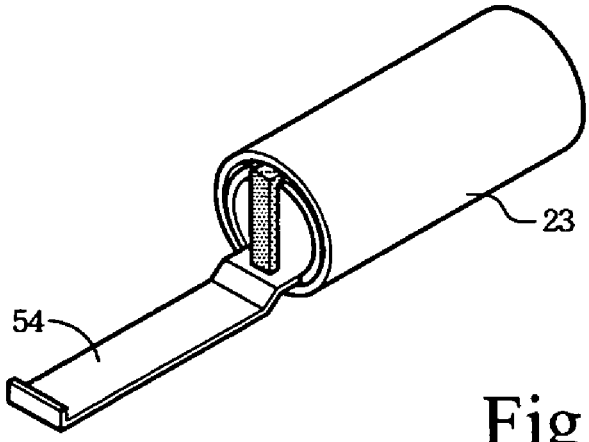
FIG. 5*d* is a schematic three-dimensional view of another preferred embodiment of the metal conductive end connector of the present invention.
Figure 5E:
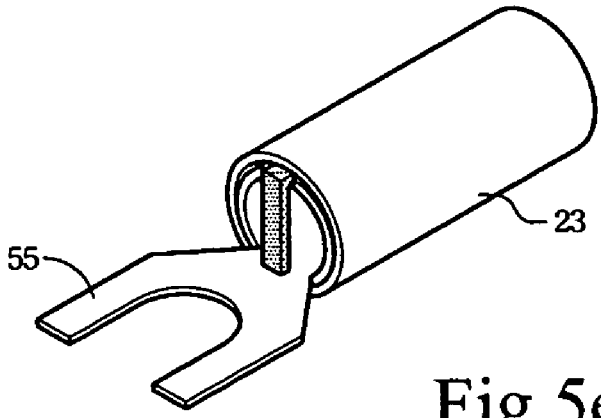
FIG. 5*e* is a schematic three-dimensional view of another preferred embodiment of the metal conductive end connector of the present invention.
Figure 5F:
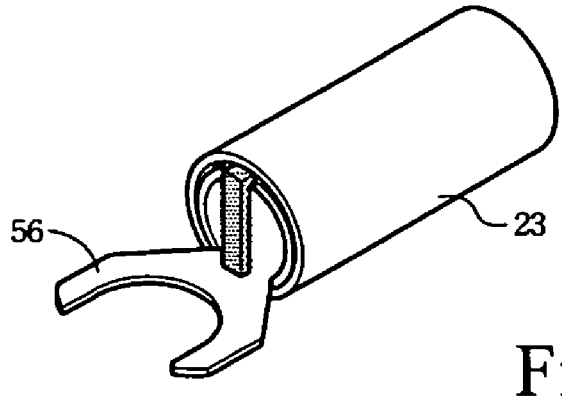
FIG. 5*f* is a schematic three-dimensional view of another preferred embodiment of the metal conductive end connector of the present invention.
Figure 5G:
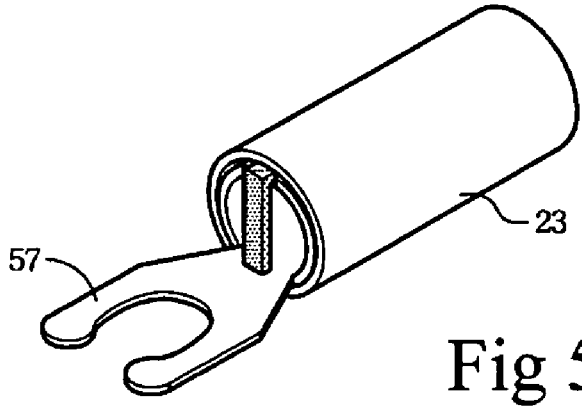
FIG. 5*g* is a schematic three-dimensional view of another preferred embodiment of the metal conductive end connector of the present invention.
Figure 5H:
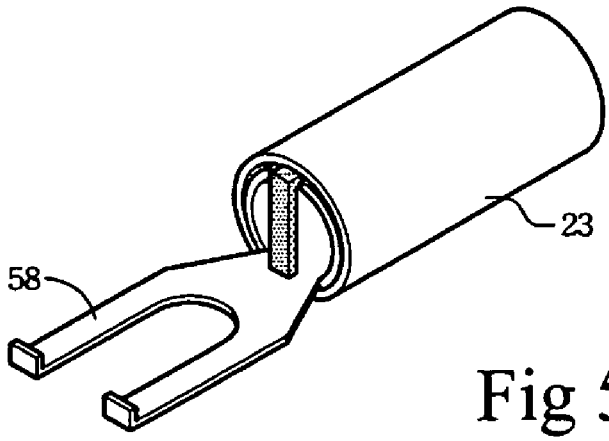
FIG. 5*h* is a schematic three-dimensional view of another preferred embodiment of the metal conductive end connector of the present invention.
Figure 5I:
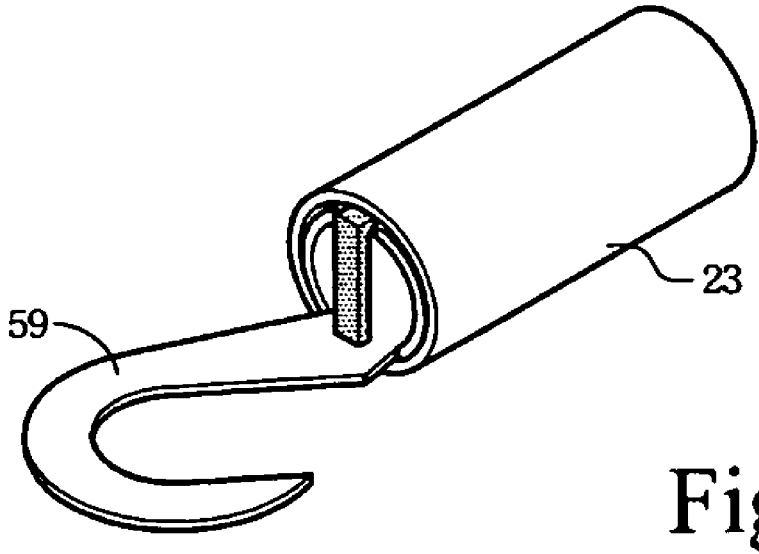
FIG. 5*i* is a schematic three-dimensional view of another preferred embodiment of the metal conductive end connector of the present invention.
Figure 5J:
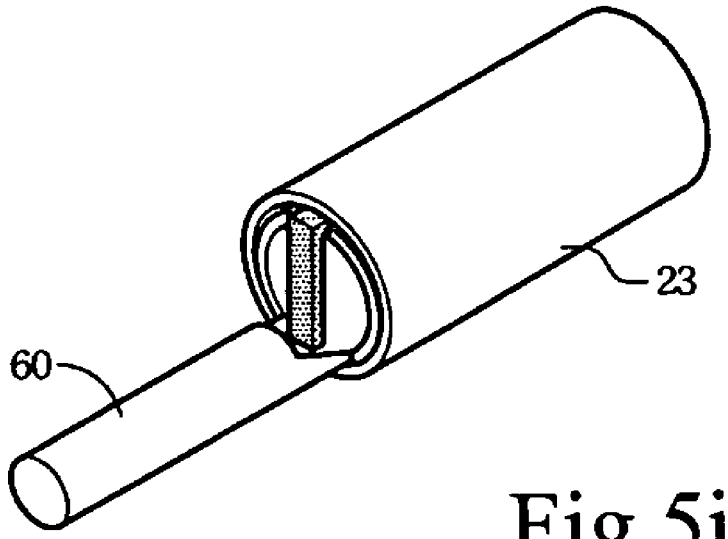
FIG. 5*j* is a schematic three-dimensional view of another preferred embodiment of the metal conductive end connector of the present invention.

As shown in FIG. 2, the second end 22 of the metal conductive end 20 is a ring-shaped disk with a hole in a center thereof; or can be a ring-shaped disk 51 which a circumference of the hole is dentoid inward, as shown in FIG. 5*a*; or can be a ring-shaped disk 52 on which a geometric surface shape is radiating indented lines in regular intervals, as shown in FIG. 5*b*; or can be a long rectangular plate 53, as shown in FIG. 5*c*; or can be the long rectangular plate 53 with a bending portion 54 at one end, as shown in FIG. 5*d*; or can be a Y-shaped plate 55 with a front opening, as shown in FIG. 5*e*; or can be a U-shaped plate 56 with a front opening, as shown in FIG. 5*f*; or can be a U-shaped plate 57 with a front opening, as shown in FIG. 5*g*; or can be the Y-shaped plate 55 which further has at least one bending portion 58 at one tail end, as shown in FIG. 5*h*; or can be a hook-shaped plate 59 with a synclinal opening in one side, as shown in FIG. 5*i*; or can be a long thin cylindrical bar 60, as shown in FIG. 5*j*; and also can be a long thin flat cylindrical bar (the figure is not shown).

For further reference as shown in FIG. 3, illustrated an exploded view of components of the metal conductive end connector 2 in the preferred embodiment of the present invention. The first end 21 of the metal conductive end 20 is folded to form a C-shaped cylinder 211 having an opening slot along in its lengthwise, and inside the C-shaped 211 cylinder is a containing room. An end of this containing room near the second end 22 is a first opening 21*a*, another end of the containing room far from the second end 22 is called a second opening 21*b*. The second opening 21*b* is used to insert a conductive core 62 stripped an insulating skin 61 of the wire at one end thereof.

Figure 4:
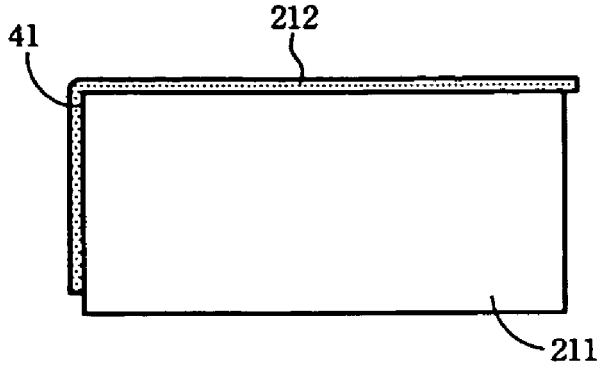
FIG. 4 is a lateral view of a preferred embodiment of a first end of the metal conductive end connector of the present invention.

For reference as shown in FIG. 3 and FIG. 4, illustrated the metal conductive end connector in the preferred embodiment of the present invention wherein the low melting metal material 212 is embedded in the opening slot of the C-shaped cylinder 211 in lengthwise along an inner wall of the containing room. One end of the low melting point metal material 212 toward the first opening 21*a* of the containing room is folded into right-angled bending, and the bending portion 41 is sealed with the first opening 21*a*.

As described in the preferred embodiment of the present invention, in particular, depicted the metal conductive end connector wherein an insulating sleeve 23 sleeves the C-shaped part 211 of the first end 21 and the low melting point metal material 212 together inside and also the insulating sleeve 23 has the feature of contraction when getting heated and its melting point is higher than the low melting point metal material 212. The length of the insulating sleeve 23 is slightly longer than the length of the C-shaped cylinder 211 and completely sleeves both the C-shaped cylinder 211 and the low melting point metal material 212 together to elongate toward the direction far away from the second opening 21*b*.

Thereby, meanwhile, the present invention provides a manufacturing method of the metal conductive end connector, described as follows;

Firstly, providing the metal conductive end 20, and the metal conductive end 20 comprises the first end 21 and the second end 22 which is opposite to the first end 21. The second end 22 is used for connecting an exterior conductive contact, while the first end 21 is folded to form a C-shaped cylinder 211 with an opening slot in lengthwise along the cylinder having a containing room inside. The one end near the second end 22 of the containing room is the first opening 21*a* while the other end far from the second end 22 at the other end of the containing room is the second opening 21*b* which is used to insert the conductive core 62 stripped an insulating skin 61 of the wire at one end thereof.

Next, providing the low melting metal material 212 which is jointed with the opening slot of the C-shaped cylinder 211 in length way along the inner wall of the containing room and the one end of the low melting metal material 212 toward the first opening 21*a* of the containing room is folded into the bending portion, and the bending portion 41 is sealed with the first opening 21*a*; and Providing the insulating sleeve 23 which sleeves around the C-shaped part 211 of the first end 21 and the low melting metal material 212. And also the insulating sleeve 23 has the feature of contraction when getting heated and its melting point is higher than the low melting point metal material 212 and the length is slightly longer than the length of the C-shaped cylinder 211 so that completely sleeves both the C-shaped cylinder 211 and low melting point metal material 212 together to elongate toward the direction far away from the second opening 21*b*.

As described in the manufacturing method of the metal conductive end connector above, as shown in FIG. 2, the second end 22 of the metal conductive end 20 is a ring-shaped disk with a hole in the center thereof; or can be a ring-shaped disk 51 which its circumference of the hole is dentoid inward, as shown in FIG. 5*a*; or can be a ring-shaped disk 52 which the geometric surface shape is radiating indented lines in regular intervals, as shown in FIG. 5*b*; or can be a long rectangular plate 53, as shown in FIG. 5*c*; or can be the long rectangular plate 54 with the bending portion 54, as shown in FIG. 5*d*; or can be a Y-shaped plate 55 with a front opening, as shown in FIG. 5*e*; or can be a U-shaped plate 56 with a front opening, as shown in FIG. 5*f*; or can be a U-shaped plate 57 with a front opening, as shown in FIG. 5*g*; or can be the Y-shaped plate 55 which further has at least one bending portion 58 at one tail end, as shown in FIG. 5*h*; or can be a hook-shaped plate 59 with a synclinal opening in one side, as shown in FIG. 5*i*; or can be a long thin cylindrical bar 60; as shown in FIG. 5*j*; and also can be a long thin flat cylindrical bar (the figure is not shown).

Figure 6:
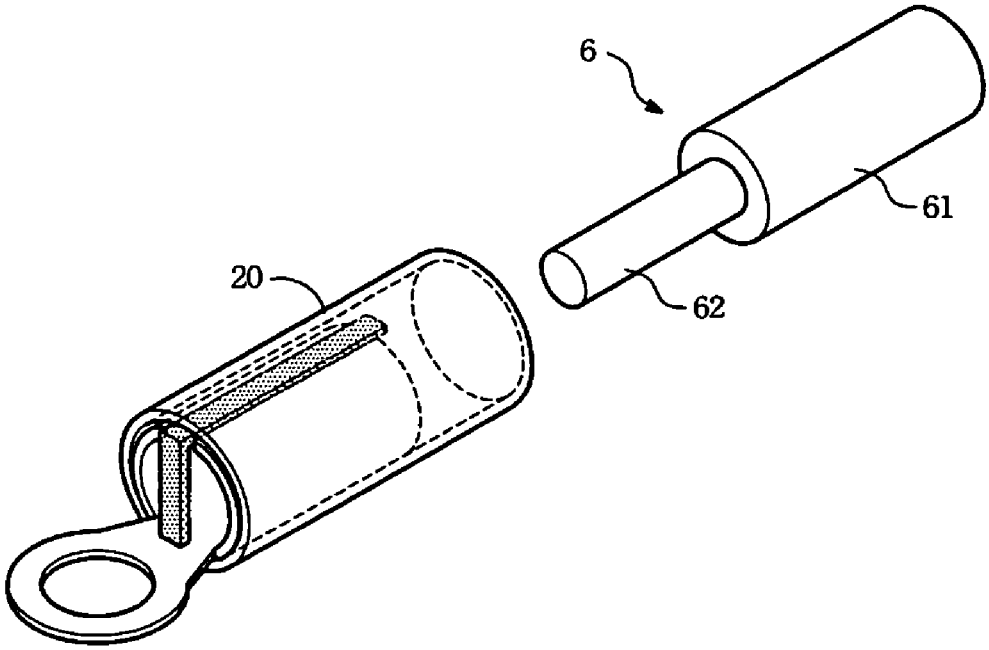
FIG. 6 is a schematic three-dimensional view of a preferred embodiment of the metal conductive end connector connecting a wire of the present invention.
Figure 7:
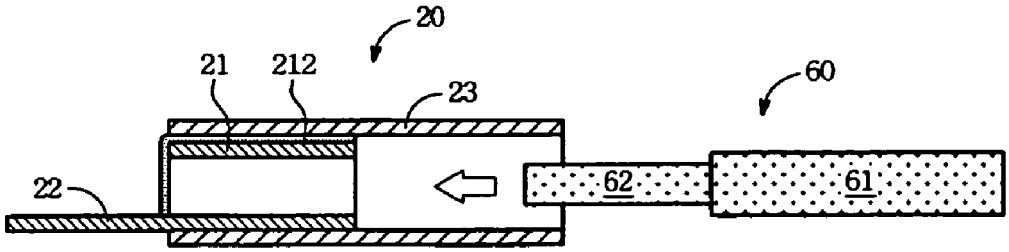
FIG. 7 is a lateral view of the connection relationship of the metal conductive end connector and the wire before getting heated of the present invention.
Figure 8:
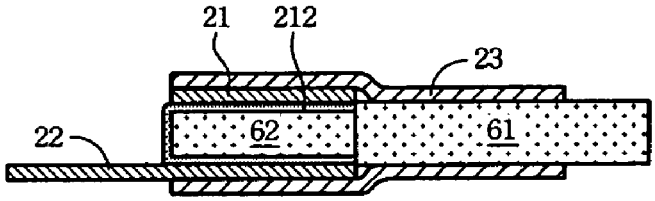
FIG. 8 is a lateral view of the connection relationship of the metal conductive end connector and the wire after getting heated of the present invention.

The present invention provides the method for connecting the metal conductive end connector and the wire, as shown in FIG. 6. Firstly, a metal conductive end connector structure is provided, a suitable length of the insulating skin 61 of the wire 6 is stripped to expose the conductive core 62, and then the conductive core 62 is inserted into the C-shaped cylinder 211 from the second opening 21*b* through to the first opening 21*a* to contact with the bending portion 41 of the low melting point metal material 212, and also let the insulating sleeve 23 take in the part of unstripped insulating skin with the exposed conductive core at the end of the wire 61 so as to complete the plug-in style connection between the connector and the wire. Next, as shown in FIG. 7 and FIG. 8, when providing a source of heat with the temperature between the melting point of the low melting point metal material 212 and the melting point of the insulating sleeve 23 so that the low melting point metal material 212 is melted into the opening slot of the C-shaped cylinder 211 along its lengthwise and further joints with the conductive core 62 so that implement the electrical connection, which the containing room of the C-shaped cylinder 211 is filled in seamlessly. Meanwhile, the insulating sleeve 23 contracts in a certain extent to female-connect both the first end 21 of metal conductive end 20 and the wire 6 with the partial insulating skin 61 together thereby complete the connection of the metal conductive end connector 2 and the wire 6.

In addition, having completed of the connection of the metal conductive end connector 2 and the wire 6, an external pinching pressure is applied on the C-shaped cylinder 211 with a tool to consolidate the connection of the metal conductive end connector 2 and wire 6.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A connector, comprising:

a metal conductive end, comprising a first end and a second end opposite to the first end and the second end being connected an external conductive contact, the first end being folded to form a C-shaped cylinder with an opening slot along lengthwise thereof and create a containing room inside the C-shaped cylinder, a first opening of the containing room being adjacent to the second end, a second opening of the containing room being far from the second end, the second opening allowing to insert a conductive core stripped an insulating skin thereof;

a low melting point metal material jointed with an inner wall of the C-shaped cylinder in the containing room along the opening slot in lengthwise and having one end with a right-angled bending toward the first opening; and an insulating sleeve being contracted while in heating, a melting point of the insulating sleeve being higher than a melting point of the low melting point metal material, a length of the insulating sleeve being longer than a longitudinal length of the C-shaped cylinder, the insulating sleeve female-connecting the C-shaped cylinder and the low melting point metal material and stretching away from the second opening.

2. The connector according to claim 1, wherein the second end is shaped as a hook with a synclinal opening.

3. The connector according to claim 1, wherein the second end is a long thin cylindrical shape.

4. The connector according to claim 1, wherein the second end is a ring-shaped disk with a hole in a center thereof.

5. The connector according to claim 4, wherein a circumference of the hole of the second end is dentoid inward.

6. The connector according to claim 1, wherein the second end is a long rectangular plate.

7. The connector according to claim 6, wherein a tail end of the second end further has a bending portion.

8. The connector according to claim 1, wherein the second end is a plate with a front Y-shaped opening.

9. The connector according to claim 8, wherein a tail end of the Y-shaped opening of the second end further has at least one bending portion.

10. A manufacturing method of a connector, comprising:

providing a metal conductive end, the metal conductive end comprising a first end and a second end opposite to the first end, the second end being connected an exterior conductive contact, the first end being folded to form a C-shaped cylinder with an opening slot along lengthwise thereof and create a containing room therein, a first opening of the containing room being adjacent to the second end, a second opening of the containing room being far from the second end, the second opening allowing to insert a conductive core stripped an insulating skin thereof;

providing a low melting point metal material to joint with an inner wall of the C-shaped cylinder in the containing room along the opening slot in lengthwise and having one end with a right-angled bending toward the first opening; and providing an insulating sleeve being contracted while in heating, a melting point of the insulating sleeve being higher than a melting point of the low melting point metal material, a length of the insulating sleeve being longer than a longitudinal length of the C-shaped cylinder, the insulating sleeve female-connecting the C-shaped cylinder and the low melting point metal material and stretching away from the second opening.

11. The manufacturing method of the connector according to claim 10, wherein the second end of the metal conductive end is shaped as a hook with a synclinal opening.

12. The manufacturing method of the connector according to claim 10, wherein the second end of the metal conductive end is a long thin cylindrical shape.

13. The manufacturing method of the connector according to claim 10, wherein the second end of the metal conductive end is a ring-shaped disk with a hole in a center thereof.

14. The manufacturing method of the connector according to claim 13, wherein a circumference of the hole of the second end of the metal conductive end is dentoid inward.

15. The manufacturing method of the connector according to claim 10, wherein the second end of the metal conductive end is a long rectangular plate.

16. The manufacturing method of the connector according to claim 15, wherein a tail end of the second end of the metal conductive end further has a bending portion.

17. The manufacturing method of the connector according to claim 10, wherein the second end of the metal conductive end is a plate with a front Y-shaped opening.

18. The manufacturing method of the connector according to claim 17, wherein a tail end of the Y-shaped opening of the second end of the metal conductive end further has at least one bending portion.

19. A method of connecting a connector to a wire, comprising:

providing a metal conductive end, the metal conductive end comprising a first end and a second end opposite to the first end, the second end being connected an exterior conductive contact, the first end being folded to form a C-shaped cylinder with an opening slot along lengthwise thereof and create a containing room therein, a first opening of the containing room being adjacent to the second end, a second opening of the containing room being far from the second end;

providing a low melting point metal material to joint with an inner wall of the C-shaped cylinder in the containing room along the opening slot in lengthwise and having one end with a right-angled bending toward the first opening;

providing an insulating sleeve being contracted while in heating, a melting point of the insulating sleeve being higher than a melting point of the low melting point metal material, a length of the insulating sleeve being longer than a longitudinal length of the C-shaped cylinder, the insulating sleeve female-connecting the C-shaped cylinder and the low melting point metal material;

providing the wire stripped a length of an insulating skin thereof to expose a conductive core, and then inserting the conductive core into the second opening of the C-shaped cylinder, continuously the conductive core contacting with the end with a right-angled bending toward the first opening of the low melting point metal material, further that a part of the insulating skin being contained in the insulating sleeve; and providing a heat source used for electrical connection of the low melting point metal material with the C-shaped cylinder and the conductive core of the wire, and also the insulating sleeve being contracted to sleeve the metal conductive end and the part of the insulating skin of the wire so as to complete the electric connection of the connector and the wire.

* * * * *